US007070505B2

(12) United States Patent
Vancura et al.

(10) Patent No.: US 7,070,505 B2
(45) **Date of Patent: *Jul. 4, 2006**

(54) METHOD FOR COMMUNITY EVENT WAGERING

(75) Inventors: Olaf Vancura, Las Vegas, NV (US); Terrance W Oliver, Reno, NV (US)

(73) Assignee: Progressive Gaming International Corp., Las Vegas, NV (US)

( * ) Notice: Subject to any disclaimer, the term of this patent is extended or adjusted under 35 U.S.C. 154(b) by 263 days.

This patent is subject to a terminal disclaimer.

(21) Appl. No.: 10/213,315

(22) Filed: Aug. 5, 2002

(65) Prior Publication Data

US 2003/0011127 A1 Jan. 16, 2003

Related U.S. Application Data

(63) Continuation of application No. 09/287,556, filed on Apr. 6, 1999, now Pat. No. 6,916,245.

(60) Provisional application No. 60/080,933, filed on Apr. 6, 1998.

(51) Int. Cl.
*A63F 13/00* (2006.01)

(52) U.S. Cl. ..... 463/25

(58) Field of Classification Search ..... 463/12–13, 463/16–22, 25–28, 30; 273/143 R, 138.1, 273/139, 269

See application file for complete search history.

(56) References Cited

U.S. PATENT DOCUMENTS 4,861,041 A 8/1989 Jones et al. ..... 273/292
5,265,882 A 11/1993 Malek ..... 273/292
5,275,400 A * 1/1994 Weingardt et al. ..... 463/12
5,328,189 A 7/1994 Malek ..... 273/292
5,362,064 A 11/1994 Lofink et al. ..... 273/292
5,395,120 A 3/1995 Malek ..... 273/292
5,476,259 A 12/1995 Weingardt ..... 273/85 CP
5,707,285 A 1/1998 Place et al.
5,743,798 A * 4/1998 Adams et al. ..... 463/17
5,743,800 A * 4/1998 Huard et al. ..... 463/26
5,779,547 A * 7/1998 SoRelle et al. ..... 463/28
5,823,873 A 10/1998 Moody ..... 463/13
5,851,011 A * 12/1998 Lott ..... 273/292
5,857,678 A 1/1999 Coleman et al. ..... 273/292
5,876,283 A * 3/1999 Parra et al. ..... 463/12
5,984,779 A * 11/1999 Bridgeman et al. ..... 463/16
6,029,976 A * 2/2000 Brunelle ..... 273/274
6,123,335 A * 9/2000 Adkins ..... 273/274

* cited by examiner

*Primary Examiner*—Kim Nguyen
(74) *Attorney, Agent, or Firm*—Dorr, Carson & Birney, P.C.

(57) ABSTRACT

A method and apparatus for wagering on a community event by a plurality of players. The apparatus includes a pay table ranking a preselected community event, a wagering place to accept individual wagers from each of the players on the occurrence of the preselected community event, a random number generator for establishing chance events during a game of chance, and a prize pool connected to the wagering place, which prize pool receives at least a portion of the accepted wagers. The players are rewarded from the prize pool if the preselected community event occurs during the game of chance. The method includes identifying. a community event, accepting wagers from players on the game of chance, entering part of the wagers into a prize pool, and rewarding the players from the prize pool if the community event occurs during the game of chance.

28 Claims, 1 Drawing Sheet

METHOD FOR COMMUNITY EVENT WAGERING

This application is a continuation of U.S. Non-Provisional patent application Ser. No. 09/287,556 filed Apr. 6, 1999, now U.S. Pat. No. 6,916,245, entitled "Replacement Baccarat Tie Wager" which application claims the benefit of U.S. Provisional Patent Application Ser. No. 60/080,933 filed Apr. 6, 1998, entitled "Replacement Baccarat Tie Wager".

THE FIELD OF THE DISCLOSURE

A game of chance with a community event on which players can optionally wager for a prize pool pay out. More specifically, the invention comprises a new version of a new Baccarat Tie variation with large, possibly wide-area-progressive payoffs and can use the so-called "safe" technology to administer the game. A method is presented to allow a third (for example a non-casino) party to broker the jackpot and participate in potentially large revenue sharing through the collection of a small percentage of total handle on the Tie wager.

BACKGROUND OF THE INVENTION

Wagering on games of chance and sporting events is manifested in many forms. The most common type of casino wager pays "odds" on a winning wager. For example, for a single number wager in Roulette, winning wagers are paid at odds of 35 to 1. These odds are applicable regardless of the amount wagered (subject to a standard maximum house-betting limit). In these cases, the fixed odds do not encourage additional wagering, as the house advantage is constant regardless of wager.

Another type of wager is a pari-mutuel, common in lotteries and some forms of sports/horse wagering. Here, players' money is pooled, less a house commission, and players are tasked with selecting the winning event. The pool is divided among those that are successful. Here, the players need to select the winning events in order to participate in any payoffs.

With progressive jackpots, players vie to obtain the predetermined combination necessary. For example, on slot machines, the winning combination is known to all, and individual players vie to line up the proper symbols in order to win the jackpot. On table games (e.g., Jones et al., U.S. Pat. No. 4,861,041, the winning combination is also known, and individual players each vie to obtain the proper arrangement of cards in order to win the jackpot. In each of these cases, players utilize their own hands and/or spins, and individual hands/spins comprise the events.

Lofink, et al. U.S. Pat. No. 5,362,064 as well as Moody U.S. Pat. No. 5,823,873 disclose the possibility of wagering in a casino game on a community event. However, these patents do not teach, disclose or suggest a method of capitalizing on the fact that all players are simultaneously desirous of winning by wagering on the community event. Moreover, these patents fail to disclose a method including a way for a third party (neither casino nor player) to capitalize on the wagering during the game.

Baccarat, Mini Baccarat (or Mini Bacc) and Big Bacc have recently continued to grow in popularity. For the state of Nevada, the past three years have seen a rise in total tables from nearly 125 to about 175, an increase of some 40%. With both Mini and Big Bacc, the game is comprised of three main wagers—Player, Banker, and Tie. Each of these wagers is primary as it may be made by itself, with no requisite-accompanying wager. If desired, more than one wager may be made. No strategy is involved on the part of the player; the only decision to be made is which of these three wagers to make.

U.S. Pat. No. 5,362,064 pertains to a modification of Baccarat. This modification eliminates the conventional 5% commission charged by the gaming establishment. The '064 invention also allows side wagers to be added to the game. The '064 teaching also provides a variation to Baccarat wherein the player's and the bank's hands operate under the same criteria as to whether a third card is or is not dealt to each respective hand. In yet another variant, the '064 patent uses a mechanical randomizing device to establish a "push" or "bar" situation for what otherwise would be a winning hand. Finally, the '064 patent permits side wagers to be added to the game. A player may make an additional wager on his hand with respect to a tie or for a natural situation.

U.S. Pat. Nos. 5,395,120; 5,328,189; and 5,265,882 allow a player to play a casino game simultaneously against a dealer and other players. Under the teachings of these inventions, a player can simultaneously play draw poker against the dealer and either twenty-one or Baccarat against other players.

U.S. Pat. No. 5,476,259 sets forth a pari-mutuel electronic and live table game wherein players compete against each other to win a common pool. They do not wager against the house. In this environment, the house retains a pre-established commission.

U.S. Pat. No. 5,857,678 has a method of playing a modified form of Baccarat played on a gaming table. The acting banker and an action player are selected from a plurality of players. The acting banker establishes a bank and each of the remaining players places a wager. The dealer deals to each player including the acting banker two cards face up. Play then commences between the action player and the acting banker and moves around the table to the next player in a predetermined order. The acting banker plays each player individually according to the standard rules of Baccarat until completion. If the acting banker wins, the player's wager is added to the bank. The acting banker is not permitted to set off the amount won. At the end of play between an individual player and the acting banker, all of the player's cards are discarded and all of the acting banker's cards are discarded except the initial face up card dealt. The acting banker in all games always retains this initial face up card with the remaining individual players. Play continues until the acting banker's bank is exhausted or until each player at the gaming table has played his dealt hand against the hand of the acting banker.

The Player and Banker wagers are often made as they have a house advantage of roughly 1.2%. This figure, coupled with the complete absence of any strategic considerations, is generally low compared to other table games (e.g., Roulette at 5.3% regardless of strategy) and has led to the notion that Baccarat is a "smart player's game." Against this backdrop, the Tie wager is seldom made because of the steep house edge of roughly 14.4%, about 12× that of either of the other two wagers.

An objective herein is to modify the Tie wager in Baccarat to make it more appealing to the playing public, preferably by using the new game with "safe" technology in a seamless, yet functional, manner. "Safe" technology, as provided by Mikohn Gaming Corporation of Las Vegas, Nev. includes a system with special betting chips that can be automatically scanned for identification and denomination by electronics located under a table layout. Furthermore, an optical card reader can be situation in a card supply shoe to provide exact information on the cards as they are dealt. Thus, exact time-stamped information about wagering and play is potentially known.

Another objective is to provide a large progressive pay out on the Tie wager, thus increasing player excitement and participation.

Another objective of this invention is to utilize community events, in general, in a manner consistent with that described for the Tie wager in Baccarat.

Another objective is to set up an algorithm so a third party can participate in revenue sharing and/or collect a percentage of total handle, based on this invention.

It is an advantage of this invention that players need not select the winning combinations, rather that winning combinations are either predetermined or randomly selected prior to the occurrence of random events. It is an advantage of this invention that community events are utilized, such that all players are simultaneously hoping for a common result. It is a further advantage of this invention that the means by which payoffs are made for such a community event occurring encourage additional wagering on the part of the players. Specifically, a portion of the invention may have a fixed house advantage, and a portion may have a variable house advantage.

SUMMARY OF INVENTION

A method of playing and wagering on a game of chance having community events may include the steps of identifying at least one selected community event; accepting wagers from one or more players on the at least one community event; generating at least one chance event during the playing of the game of chance, and perhaps rewarding the one or more players from a prize pool should the at least one selected community event occur during the chance event. The added step of splitting the prize pool among all those that wager on the occurrence of the community event during the step of generating the chance event is preferred but not essential. The method can have the selection of the community event occurs after the step of accepting wagers. The method preferably has the step of generating at least once chance event by including one of the following steps dealing cards, spinning one or more wheels or drawing numbered balls. The method might have the step of adding to the prize pool at least a portion of the accepted wagers. The method could also include the step of increasing the prize pool whenever the at least one selected community event does not occur.

The step of rewarding each player preferably includes the step of determining the amount of each player's reward as a function of the amount of that player's wager. The method has in addition the step of basing the determining the reward of each player on the proportion of the fraction of total wagers made by all the wagering players during that game of chance that the amount of the player's wager represented.

The method is robust and can provide the step of selecting the community event from games of chance including games such as Blackjack, Baccarat, Roulette, Pai Gow, Pai Gow Poker, Keno, Caribbean Stud, Let It Ride, Acey-Deucey. Playing the game of chance of Baccarat wherein the at least one community event may be a type of tie or equal point count between the player's and banker's hand is preferred. Wagering on the game of chance of Baccarat when the at least one community event might be a type of tie or equal point count between the player's and banker's hand is an alternate possibility.

In the game of Blackjack, all players play against the dealer. Hence, the dealer's hand is a common event to all players. It may be adopted as the "community event." For example, the winning community event could be selected from the group of:

Dealer Blackjack pays 15 for 1,

Dealer 7-7-7 all wagering players share in 10% of the prize pool, or

Dealer Spades 7-7-7 all wagering players share in 100% of the prize pool.

In Roulette, the result of the spin is common to all players. Hence, one or more of these results may be adopted as the community event. For example, the following paytable of winning selected community events may be adopted:

Any zero (0 or 00) pays all wagering players 10 for 1,

Back to back any zero pays all wagering players 10% of the prize pool, or

Back to back to back any zero pays all wagering players 100% of pool.

In Keno, the 20 balls that are drawn are common to all players. Hence, the 20 drawn balls may be adopted as the community events and selected of these outcomes adopted as the paytable. For example, all even, all odd, all divisible by the number 3, all the end with the number 9, all low numbers on the top half of the board, or all high numbers on the bottom half of the board.

Similarly, in other casino games, an event common to all players participating may be utilized as the community event. Specific instances of the community event may be used as winning hands. Examples include Pai Gow (the dealer's hand), Pai Gow Poker (the dealer's hand), Caribbean Stud (the dealer's hand), Let It Ride (the two community cards), and Acey-Deucey (the three community cards). In each of these cases, selected subsets of all possible community events may be adopted as preselected winning events.

The method wherein the more than one community events can include some which pay fixed odds to the wagering and winning player, and others which pay from the prize pool by proportioning the rewarding of each wagering and winning player according to the fraction of total wagers made by all the players during that game of chance that the respective player's wager represented.

A method of wagering on a game of chance having events can include steps of Identifying at least one selected community event; accepting wagers from one or more players on the at least one community event; generating chance events; rewarding each of the one or more players that wagered on the occurrence of the community event from a prize pool should the at least one community event occur during the step of generating chance events, and basing the rewarding of each player on the amount of that player's wager. The method wherein the step of generating chance events preferably includes the dealing of cards. The method with the step of generating chance events is alternatively spinning one or more wheels of chance. The method presented allows a third (for example a non-casino) party to broker the jackpot and participate in potentially large revenue sharing through the collection of a small percentage of total handle on the Tie wager.

An apparatus for wagering from one or more players on a game of chance having events, preferably has a pay table ranking one or more preselected community events and a wagering place to accept individual wagers from each of the one or more players on the occurrence of the at least one community event. The apparatus of the preferred embodiment has a random number generator for establishing chance events and a prize pool connected to the wagering place. The prize pool may receive at least a portion of the accepted wagers and to reward each of the one or more players if at least one community event occurs. The reward is most preferably relative to the amount of that player's wager.+

DETAILED DESCRIPTION OF THE INVENTION

Figure 1:
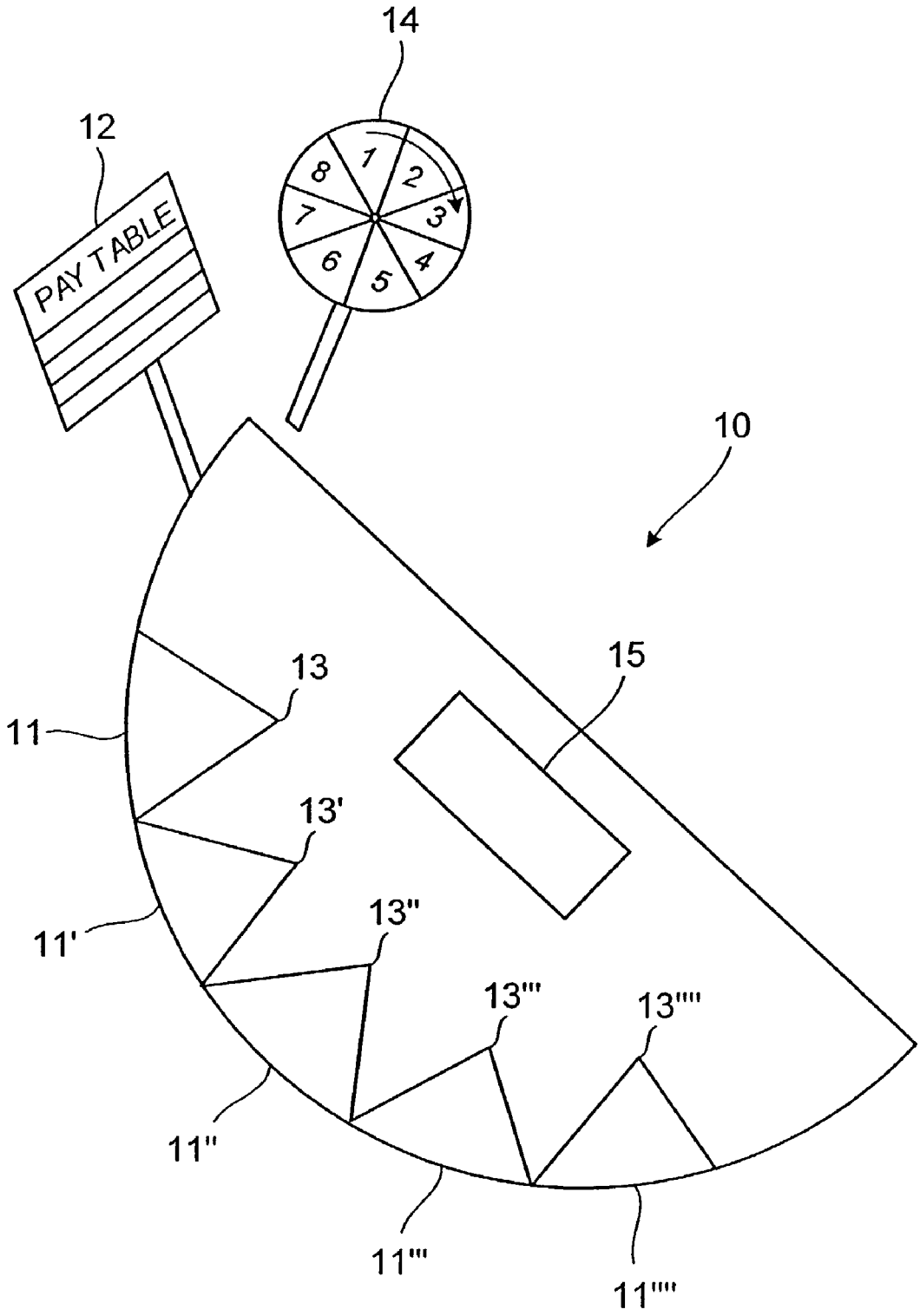
FIG. 1 is a perspective of an apparatus, for wagering by one or more players on a game of chance having events, having a pay table ranking one or more preselected community events and a prize pool.

A method of playing and wagering on a game of chance has community events. The method steps are:

identifying at least one selected community event;

accepting wagers from one or more players on the at least one community event;

generating at least one chance event during the playing of the game of chance, and rewarding the one or more players from a prize pool should the at least one selected community event occur during the chance event by distributing winnings according to the amounts wagered by each of the one or more wagering players.

An added step requires splitting the prize pool among all those that wager on the occurrence of the community event during the step of generating the chance event. The method also has the occurrence of the selection of the community event before or after the step of accepting wagers. The method has the step of generating at least once chance event by one of the following ways dealing cards, spinning one or more wheels or drawing numbered balls. The method has alternately the step of adding to the prize pool at least a portion of the accepted wagers. The method includes alternatively the step of increasing the prize pool whenever the at least one selected community event does not occur and/or paying a part of the prize pool to a third party.

The step of rewarding each player has in an alternate approach the step of determining the amount of each player's reward as some function of the amount of that player's wager. The method has in addition the step of basing the determination of the reward of each player on the proportion of the fraction of total wagers made by all the wagering players during that game of chance that the amount of the player's wager represented. The method has the step of selecting the community event from games of chance such as the table games Blackjack, Baccarat, Roulette, Pai Gow, Pai Gow Poker, Keno, Caribbean Stud, Let It Ride, Acey-Deucey. Playing the game of chance of Baccarat with the community event being a type of tie or equal point count between the player's and banker's hands. Wagering on the game of chance of Baccarat when the community event is a type of tie or equal point count between the player's and banker's hand is a method step.

The method during the game of Blackjack and the community event is a dealer's hand such as:

Dealer Blackjack pays 15 for 1,

Dealer 7-7-7 all wagering players share in 10% of the prize pool, or

Dealer Spades 7-7-7 all wagering players share in 100% of the prize pool.

The method during the game of Roulette and the community event is, for example, as follows:

Any zero (0 or 00) pays all wagering players 10 for 1,

Back to back any zero pays all wagering players 10% of the prize pool, or

Back to back to back any zero pays all wagering players 100% of pool.

The method during the game of Keno and the community event occurs when the Keno numbers drawn are as follows:

all even, all odd, all divisible by the number 3, all the end with the number 9, all low numbers on the top half of the board, or all high numbers on the bottom half of the board.

A method with the occurrence of more than one community event for which the reward pays fixed odds to the wagering and winning player, and other rewards pay from the prize pool by proportioning the jackpot pay out of each wagering and winning player according to the fraction of total wagers made by all the players during that game of chance that the respective player's wager represented.

A method of wagering on a game of chance having events can include steps of Identifying at least one selected community event; accepting wagers from one or more players on the at least one community event; generating chance events; rewarding each of the one or more players that wagered on the occurrence of the community event from a prize pool should the at least one community event occur during the step of generating chance events, and basing the rewarding of each player on the amount of that player's wager. That method with the step of generating chance events includes the dealing of cards or alternatively spinning one or more wheels of chance.

An apparatus 10 for wagering by one or more players 11, 11', 11", 11'" or 11"" on a game of chance having events is shown schematically in FIG. 1. The apparatus 10 includes a pay table 12 that has the relative ranking of the one or more preselected community events. The pay table 12 displays to the one or more players 11, 11', 11", 11'" or 11"" the pay out each might receive for correctly wagering on each of the community events. If the game of chance is a live table game including cards, then a wagering place 13, 13', 13", 13'" or 13"" is provided on the game table of the apparatus 10 for each of the respective players 11, 11', 11", 11'" or 11"" to place a bet in the form of a gambling chip or token.

A random number generator 14 is shown in FIG. 1 as a wheel to spin for selecting a number. This is not to limit the random number generator 14 to the wheel specifically disclosed as many forms of electronic and manual random number generators 14 exist and are used for casino play. On the apparatus 10 there is a place for a prize pool 15. Although shown as merely a spot for the dealer to keep the tokens or coins wagered on the community event, it should be understood that any form of prize pool 15 is contemplated. Specifically, electronic memory for tallying the input and output of the side bets on the community events during play and for automatically calculating the pay out, in for example accordance with the pay table 12, is also considered to be acceptable substitutes for the prize pool 15. Consequently, the prize pool 15 may be manual, semi automatic or fully automatic as each of those are used and in practice in the gaming industry. Thus the prize pool 15 receives a part of the accepted wagers of the one or more players 11, 11', 11", 11'" or 11"" participating in the community event wager.

The prize pool 15 is then used to reward each of the winning players 11, 11', 11", 11'" or 11"" in according to the relative amount of each winning players 11, 11', 11", 11'" or 11"" wager. Moreover, the automatic handling of the prize pool makes the calculation and accounting for the third party's percentage of the undistributed prize pool easy to settle and keep track of for periodic payment.

In another embodiment, a winning community event could be a qualifier for a secondary game. The secondary game would then be played for determining the distribution of prize pool rewards. In this way the player who had wagered the most would have a proportionally greater chance to win the secondary game (e.g., by lottery). In addition, the prize could be split so the winner of the secondary game receives the majority of the prize pool while the remaining players receiving the remainder of the prize pool.

The examples that are disclosed are not limiting to the concept to be protected by claims. The invention of a community event wager as set forth in the specific alternatives explained and the methods and apparatus of the claims appended to this disclosure should include equivalent methods and apparatus for a wide range of community events and games of chance even though not specifically disclosed.

In Baccarat for example, the cards are "community cards" in the sense that all players' fates rely on the same set of 4 to 6 cards. In one preferred embodiment of this invention, a specific combination of cards is used as the qualifying hand to win a top prize. An advantage of the invention is thus that all players wagering on a Tie when the qualifying hand appears may share in the top prize. In one embodiment, players may receive a portion proportional to their wager. In another, e.g., players may receive equal portions if they have wagered a minimum amount.

Two approaches to increasing house revenue via the Tie wager are outlined.

1) Replace the Tie wager with one that has essentially the same house advantage.
2) Replace the Tie wager with one that lowers the house advantage, hence benefiting the player. For example, instead of paying the Tie wager 8 to 1, we can pay more for two-card ties of Natural 9 vs. Natural 9. The underlying belief is that players will recognize the better return, and their increased incremental play will more than make up for the decreased house edge.

The second must be exercised in moderation. For example, care must be taken if the house advantage on the Tie wager is lowered to 7.2% (half of its present value). For if play on the Tie does not double (twice its present value), the "new variation" will be a net loser for the house and will not meet with acceptance. However, it is believed that moderate variations in the house edge (i.e., an advantage between 10% and 15%) will be accepted and widely desirable in most markets. The reasoning is that the increased wagering on Tie will more than make up the shortfall in house advantage.

It is believed the best way is to repackage the Tie wager, providing for huge potential payoffs, while changing the overall house edge slightly. In essence, a menu of variations to the game may be offered, thereby allowing each casino to select the desired house edge. This approach would appear to be marketable to the casinos, as those with concerns may keep the advantage the same, while more progressive casinos (or those wishing to stimulate Tie wagering) may adopt a more player-friendly house advantage. It is desirable to allow the various casinos to select the variation they desire, but still have the capability of using a common progressive jackpot. A method allows a third (for example a non-casino) party to broker the jackpot and participate in potentially large revenue sharing through the collection of a small percentage of total handle on the Tie wager.

To date, Baccarat does not offer the excitement of volatility to the player which can be achieved, for example, at Roulette, Craps (by selecting proposition bets) and slot machines. Enhancing the Tie wager in Baccarat to attract more play could create more of a jackpot effect for the game and increase the volatility experienced by the player.

Packaging the Tie wager payoffs and jackpots with an appropriate multi-sensory experience including signage and prize meters could also serve to attract new players to the game.

The two mathematical methods for achieving this are the following:

1) Enhance the Tie wager payoffs. I.e., keep most tie hands at 8 to 1. Create higher payoffs for very rare hands. The house edge will remain roughly the same by virtue of the higher payoffs arising on very rare hands.
2) Modify the Tie wager payoffs, i.e., lower most tie-hand payoffs to less than 8 to 1. This creates additional "capital" with which to enhance payoffs for other tie hands.

In essence, the embodiments described below serve to enhance play by making the Tie wager more appealing to players from primarily a "sizzle" point of view. The change in house advantage is generally slight so as to minimize impact. The invention also uses associated Safe technology, signage, and meters to stimulate play through appropriate packaging. It allows for a third party to participate in revenue.

DESCRIPTION OF POSSIBLE EMBODIMENTS

The invention is quite robust in that many possibilities exist. One can think of Baccarat loosely as a "variable reel" slot machine with four to six reels (represented by the number of cards drawn) with 411 to 416 stops and 52 different reel symbols. We may thus "price" the game similarly to the popular progressive $1 slot machines "Mega-Bucks." Here we describe a few embodiments to give a flavor of what is possible.

Embodiment #1

Enhance Tie wager to make it more beneficial to the player, but keep most of the payoffs the same. Do not introduce a progressive, but instead pay fixed odds on all winning hands. E.g., adopt the following payoffs, and associated packaging:

TABLE I

| | Tie Wager Pay | |
|---|---|---|
| Hand | Payoff | Approx. Probability |
| Ordinary Tie | 8 to 1 | 0.07314 |
| Natural 8 vs. 8 | 8 to 1 | 0.00890 |
| 3-card 8 vs. 8 | 8 to 1 | 0.00208 |
| Natural 9 vs. 9 | 8 to 1 | 0.00897 |
| 3-card 9 vs. 9 | 9 to 1 | 0.00206 |
| A-8 vs.A-8 * | 10 to 1 | 0.000133 |
| A♠-8♠ vs. A♠-8♠* | 1,000 to 1 | 1.25e-7 |

*Any order

The change in expectation is therefore approximately:

$$\Delta E \cong (0.00897)(1)+(0.00206)(1)+(0.000133)(92)+(4.25e\text{-}7)(992) \cong 0.0236$$

Therefore, the new expectation for the Tie wager becomes:

$$E \cong -0.1436+0.0236 \cong -0.12$$

Thus, the Tie wager has been modified from its original −14.36% to −12%. This has been accomplished by adding additional payoffs to relatively rare hands.

Many other variations of this theme are possible. The limiting case might be to pay bonuses only for rare specific card arrangements (as in the A-8 vs. A-8 example above) and to pay nominal payoffs for any other general.

However, aside from a standard periodic royalty or rent, a third party would not have a natural mechanism with which to participate in revenue sharing.

Embodiment #2

Modify Tie wager, hopefully to enhance player appeal, although not necessarily with an increased player return.

To have a progressive component several possible "jackpot" hands could cause the progressive to be paid. Clearly, many other possibilities exist, and order may also be used in determining qualification.

Examples of Possible Jackpot Hands and Associated Probabilities

| | |
|---|---|
| Suited 0-0-0 vs. Same Suited 0-0-0 | 1 in 1.92 m |
| 7-7-7 vs. 7-7-7 | 1 in 7.66 m |
| 0♠-0♠-0♠ vs. 0♠-0♠-0♠ | 1 in 7.68 m |
| Suited 0-0-9 vs. Same Suited 0-0-9 | 1 in 22.1 m |
| Suited 2-3-4 vs. Suited 2-3-4 | 1 in 397 m |
| 2♠-3♠-4♠ vs. 2♠-3♠-4♠ | 1 in 7.09 b |

If it is desired to invoke a minimum $5 wager to participate in this wager (e.g., the table minimum for the Tie wager may be $5). Then consider the following pay table:

EXAMPLE A

TABLE II

| Tie Wager Pay | | |
|---|---|---|
| Hand | Payoff | Probability[1] |
| Ordinary Tie | 7 to 1 | 0.0731 |
| 8 vs. 8 | 9 to 1 | 0.0104 |
| 9 vs. 9 | 9 to 1 | 0.0105 |
| Suited Natural 8 vs. Other Suited Natural 8 | 20 to 1 | 1 in 2,420 |
| Suited Natural 9 vs. Other Suited Natural 9 | 20 to 1 | 1 in 2,340 |
| Suited Natural 8 vs. Same Suited Natural 8 | 50 to 1 | 1 in 7,720 |
| Suited Natural 9 vs. Same Suited Natural 9 | 50 to 1 | 1 in 7,440 |
| Suited 3-card 8 vs. Other Suited 3-Card 8 | 200 to 1 | ~1 in 168,000 |
| Suited 3-card 9 vs. Other Suited 3-Card 9 | 200 to 1 | ~1 in 168,000 |
| Suited 3-card 8 vs. Same Suited 3-Card 8 | 1,000 to 1 | ~1 in 550,000 |

TABLE II-continued

| Tie Wager Pay | | |
|---|---|---|
| Hand | Payoff | Probability[1] |
| Suited 3-card 9 vs. Same Suited 3-Card 9 | 1,000 to 1 | ~1 in 550,000 ~0.83 |
| 7-7-7 vs. 7-7-7 | Jackpot | ~1 in 7.66 m |

Jackpot starts at $1,000,000

Note that the only "negative" modification is that ordinary ties now pay 7 to 1, instead of the usual 8 to 1. This "gains" the house roughly 7.3%, and allows considerable enhancements for a plurality of other winning hands, beginning with the fairly frequent 8 vs. 8 or 9 vs. 9, which now pay 9 to 1. The expected return, not considering the jackpot, is roughly 0.835 units for every 1 unit wagered on this Tie bet.

[1]Probabilities calculated via one or more of probability calculation, combinatorial code, Monte Carlo simulation of 200 m hands.

Next, consider the 7-7-7 vs. 7-7-7 jackpot sequence, which occurs roughly once every 7,660,000 dealt hands. Recall that the minimum wager on the Tie is $5. If a third party allots 2.6% of this initial $5 ($0.13) to go toward paying the seed, then on average they will collect $1,000,000 before the jackpot hand occurs. Thus, the 2.6% of the initial $5 every round pays for initial jackpot seed. Thus, regardless of how much is wagered per round, only $0.13 per round goes toward the seed.

Thereafter, allotment of 1% of all cumulative Tie wagers per round above $5 to go toward the Jackpot. For example, if the cumulative Tie wager for a particular round were $150, then 2.6% of $5 would go toward the seed, and 1% of the remaining $145 would go toward the progressive meter. Under these conditions, the jackpot level will rise in the following fashion:

| Average Cumulative Tie W Wager (per round) | Average Increment to Jackpot (when hit) | Average Total Jackpot (when hit) |
|---|---|---|
| $10 | $383,000 | $1,383,000 (×2) |
| $25 | $1,532,000 | $2,532,000 (×2) |
| $100 | $7,277,000 | $8,277,000 (×2) |
| $500 | $37,917,000 | $38,917,000 (×2) |

Note that a third party banking the progressive jackpot may elect to pay out the prize winnings as an annuity, rather than cash. For example, if paid in equal installments over a span of 20 years, the jackpot winnings can be roughly twice (×2) the above values. Alternately, the jackpot winnings can be as shown (×1), and the third party could pocket the extra differential of roughly 0.5%. In this case, the third party need collect only 1.3% of the initial $5 and put 0.5% of any amount thereafter toward the meter.

Frequency of Hits: If it is assumed that the Progressive Tie Baccarat will be on 40 linked tables and if it is also assumed that 50 hands per hour per table are played, then 2,000 hands per hour are completed. This would be about 200,000 hands per week, if each table is open about 50% of the time. Therefore, the jackpot hand of 7-7-7 vs. 7-7-7 will hit every 38 weeks or so.

Once the jackpot hits, it is paid to the entire table. That is, everyone who had wagered on Tie is due a portion of the jackpot. In one embodiment as explained, the fraction due each player is simply the respective fraction of the total Tie wager that the player made. For example, consider three people wagering on Tie with bets of $10, $100, and $40.

Should the jackpot hand arise, the first player is due \$10/\$150=1/15 of the jackpot. The second player is due \$100/\$150=2/3 of the jackpot. The third is due \$40/\$150=4/15 of the jackpot. Other methods of sharing the progressive jackpot are also possible.

The community pot has some interesting ramifications. The first, as mentioned above, is that a shared jackpot which can be weighed by wager. Thus, a player wagering \$x, if hitting the jackpot, will be given a prize that is a function not only of x, but also the other wagers at the table. The second is that, regardless of how many folks wager on Tie, the chance of it hitting is the same as if only one person had wagered on it. This is unlike, e.g., Caribbean Stud poker or Let It Ride poker, and in conjunction with the community pot, potentially allows the jackpot level to rise higher than would otherwise be anticipated. The community pot also allows, indeed encourages, folks to wager more money, to get a bigger fraction of any potential jackpot. The competition among players at the same table vying for the larger share of the jackpot introduces a different and dynamic element to the game. This allows for a greater house win, but also for more rapid growth of the jackpot value.

Third Party Earnings: Most importantly, the structure of the game as presented herein will allow a third party (not necessarily the casino) to participate in revenue. The third party can "run the show" with regard to the jackpot, and make money in the following fashion, Third party takes 2.6% of the initial \$5 per round for the seed.

Third party takes 1.5% of any amount over \$5 per round as our fee.

Of this, 1% goes to the meter, and third party retains 0.5% as revenue.

Note that the above is exemplary, and other possibilities are certainly available. Thus, the above percentages and dollar amounts are not meant to limit the invention, but rather provide examples. With the above considerations and under the assumption of 200,000 hands per week, the third party would earn the following on a weekly basis:

| Average Cumulative Tie Wager (per round) | Weekly Earnings (0.5% of Column 1 less \$5) | Annual Earnings (52 × Column II) |
|---|---|---|
| \$10 | \$5,000 | \$260,000 |
| \$25 | \$20,000 | \$1,040,000 |
| \$100 | \$95,000 | \$4,940,000 |
| \$500 | \$495,000 | \$25,740,000 |

Note that the third party assumes a risk only if the jackpot hits very early. To avoid this risk, it may insure against a premature hit of the progressive.

Alternatively, for example, a third party can simplify matters by taking, e.g., a fixed 1.5 percent of total Tie handle, under the assumption that the average cumulative Tie wager will be much greater than \$5. That is, Third party takes 1.5% of total Tie handle per round as our fee.

Under this scenario, the break-even point (to make up the 1.1% shortfall on the first \$5 from the previous illustrative example) is an average cumulative Tie wager (per round) of \$8.67. That is, an average Tie wager per round of \$8.67 will exactly pay for the initial seed. Thus, a third party can collect 1.5% of the total, set aside the first 1.5%×\$8.67 for the seed, add 1% of the remainder to the meter, keeping the other 0.5% of the remainder as revenue.

In either of these examples, as far as the casino is concerned, a third party is taking very nearly 1.5% of their total Tie action, which comes "off the top" whether the house wins or loses. As mentioned before, a third party may use Safe technology to accurately measure the total Tie handle in order to perform this calculation. Despite the "cut," with the payoff table above, the house advantage on the Tie wager will be approximately, $$\text{House Advantage}=1-0.015-0.83=0.155=15.5\%$$

This is completely in line with the present house advantage for Tie. Indeed, it increases the house edge slightly.

EXAMPLE B

Consider, as an alternate example, utilizing "Flush 0-0-0 vs. Same-Flush 0-0-0" as the Jackpot qualifying hand. Thus in Table II from Example A above, replace

| | | | |
|---|---|---|---|
| | 7-7-7 vs. 7-7-7 | Jackpot | ~1 in 7.66 m |
| with | | | |
| | Flush 0-0-0 vs. Same-Flush 0-0-0 | Jackpot | ~1 in 1.92 m |

Here, the jackpot will occur roughly once every 1,920,000 hands. Thus, using the same \$5 minimum Tie wager, we find that in this case, we would need to take 10.4% of the first \$5 to pay for the seed of \$1,000,000.

Thereafter, if we allot 1% of all Tie wagers above \$5 to go toward the Jackpot, then it will rise according to the average cumulative Tie wager per round in the following fashion:

| Average Cumulative Tie Wager (per round) | Average Increment to Jackpot (when hit) | Average Total Jackpot (when hit) |
|---|---|---|
| \$10 | \$96,000 | \$1,096,000(×2) |
| \$25 | \$384,000 | \$1,384,000 (×2) |
| \$100 | \$1,824,000 | \$2,824,000 (×2) |
| \$500 | \$9,504,000 | \$10,504,000 (×2) |

Frequency of Hits: If we make the same assumptions as above (200,000 hands per week), then the jackpot will hit every 9 or 10 weeks.

Third Party Earnings: Calculation similar to above.

Embodiment #3

A hybrid of embodiments #1 and #2 in that we keep the Tie as a minimum 8 to 1 payoff, but also provide a progressive. For example,

TABLE III

Tie Wager Pay

| Hand | Payoff | Probability[2] |
|---|---|---|
| Ordinary Tie | 8 to 1 | 0.0835 |
| 9 vs. 9 | 9 to 1 | 0.0105 |
| Suited Natural 9 vs. Suited Natural 9 | 20 to 1 | 1 in 1,780 |
| Suited 3-card 9 vs. Suited 3-card 9 | 100 to 1 | ~1 in 129,000 |
| | | ~0.87 |
| 7-7-7 vs. 7-7-7 | Jackpot | ~1 in 7.66 m |

Jackpot starts at \$1,000,000

[2]Probabilities calculated via one or more of probability calculation, combinatorial code, Monte Carlo simulation of 200 m hands.

It will be obvious to players that this Tie is better than what they are presently offered. The house advantage for this payoff table, if 1.5% comes "off the top," will be roughly 11.5%. The issue will be whether the incremental play more than makes up for the fact that the house advantage has decreased. It is believed that it will, and that this is a strong selling point to the general public to increase Tie wager play.

The perceived benefits to a third party are participation in revenue sharing, which could be very lucrative. The possibility that such a third party does not charge "rent" for this game (as is commonly done for novelty table games), rather that their proceeds arise from an administrative fee, which may be a percentage of total handle, should be considered a further advantage.

Too, the 1.5% figure and type of calculations presented here are exemplary, and the fee and fee structure may be modified to be any percentage and/or alternate arrangement deemed suitable to the casino and third party. The important concept is that a fee may be collected, which may be a percentage of total handle on Tie, and from this fee pay the jackpot and retain revenue for the third party also.

A third party may, for an additional small percentage, agree to reimburse the casino for any large payoffs resulting from some of the other large odds winning hands (e.g., 1,000 to 1). This calculation is straightforward based on the chance of the hand occurring and resultant payoff, and will be a function of total Tie handle. This may be especially useful for smaller casinos to be able to participate in this game without incurring large volatility swings. Along this same vein, it should be clear that the third party may also set up an arrangement whereby, for a slightly larger percentage of the total action, the third party will cover any subset, up to all, of the payoffs in excess of the standard 8 to 1. Thus, in a limiting case, the casino pays a percentage of the total Tie handle as a fee to the third party brokering the game, and thereafter the casino is only responsible for paying the initial 8 to 1 (or any agreed upon value or odds) on any tie hand.

The perceived house benefits are a Tie wager with much more sizzle including a large, $1,000,000 or more progressive jackpot at little or essentially no net cost. The third party will cover the risk of paying the jackpot, and furthermore, the house advantage on the game is essentially the same as it has always been.

It should be clear, too, that a wide variety of payoff tables might be offered, depending on clientele. For example, as described above, a "normal" tie may be paid at 6 to 1 or 7 to 1, instead of the usual 8 to 1. In so doing, the upper end of the payoffs may be further padded. From a third party marketing point of view, a menu of choices may be offered to the house, yet various sites may still be linked together via the common progressive jackpot, for example via a wide-area-progressive network.

It should be clear, also, that some of the payoffs may be fixed (i.e. not "to 1" and not a progressive). That is, a specific type of Tie hand may pay, e.g. $10,000, regardless of the exact amount of the Tie wager.

It is a further advantage of this invention that some of the payoffs on the replacement Tie wager may be odds "to 1" so that players wagering more will receive a higher payoff if successful, while the progressive (if split among the entire table) may be used to allow players wagering less to still receive a potential large sum of money. It is a further advantage of this invention that since the jackpot is paid to all qualifying wagers when hit, that at least one such wager will hopefully always be made.

It should be clear, too, that more than one progressive qualifying hand may be used. In this case, several different hands may each pay the top prize, or may each pay a different prize. If each of several different hands pay different prizes, then each such different prize may represent a portion of a single running progressive meter, or may represent separate running progressive meters.

In another embodiment, only a fixed portion (e.g., the first $10) of any Tie wager is considered for this replacement Tie wager, the remaining amount going toward, say, a traditional Tie bet. In this case, calculations such as those presented above may be based only on the fixed portion.

Alternately, the entire amount of the Tie wager may be used for the "odds" ("to 1") portion of the pay table, and a fixed portion applied toward a calculation of dividing the progressive amount, if hit. In this case, the calculations such as presented above may proceed based on which handle—total Tie or just the fixed portion—the third party receives as its fee for brokering the game.

The teachings of this invention have the progressive prize awarded to the players wagering on Tie during the winning tie hand. In addition to weighting by Tie wager, other arrangements may be used to divide the community progressive pot, should the community hand be a winner. These include, but are not limited to, giving it entirely to the player with the highest wager, dividing it such that each player's expectation in making the Tie wager is the same (which in some cases will be the same as weighting by Tie wager), playing additional cards or hands of Baccarat to determine the division, and so forth.

It should also be noted that the order of the cards may be used in determining winning Tie hands, as well as suits, etc., duplicate cards (e.g., 8♥-8♥) may also be used.

A standard pari-mutuel accumulates a prize pool (of current wagers only), takes a portion "off the top" for house share, and distributes the remainder to the winners. Here, there need not be any winner on a particular round (unlike pari-mutuel).

Standard progressives (e.g., Caribbean Stud) work in a similar fashion and need not have a winner on a particular round, but continue to accumulate for current and past wagers. Here, we can (but do not have to) use a progressive. Unlike standard progressives, however, players here are wagering on a community (common to all) event, and players are splitting the jackpot amongst all such winning wagers. These features are novel.

In the present game, the community (or winning) events are pre-chosen and identified, and the chance event may or may not match it. Players may choose which community events to wager on. But this is unlike the lottery in which the chance event equals the winning event (i.e., the numbers drawn are the winning numbers), and the player's selected events may or may not match it.

More examples in other games of chance include. In another embodiment suitable for Blackjack, the dealer's hand may serve as the community event. That is, because each player plays against the dealer, the dealer's hand is "common" and potentially impacts all players, and can therefore serve as the community event for all players. This can be contrasted with an individual player's hand, which has no meaning or impact for any other player.

Hence, a suitable embodiment of this invention is to allow a side wager on Blackjack as the resulting dealer's hand. For example, the following pay table may be utilized with a 6-deck game and a minimum wager of $1:

| | | |
|---|---|---|
| Dealer Blackjack | 15 for 1 | ~1 in 21 |
| Dealer 7-7-7 | Share in 10% of the prize pool | |
| Dealer Spades 7-7-7 | Share in 100% of the prize pool | ~1 in 250,000 |

The term "community event" is an event common to all participants in at least one game. Hence, the community events comprise not only the tie in Baccarat but also various forms of a dealer Blackjack (a total of 21 on the first two cards).

In a preferred embodiment, 10% of every player's wager is contributed to the prize pool. Should the dealer receive 7-7-7, players who wagered on the community event would share 10% of the current prize pool, which would then be decremented by that 10% value. Should the dealer receive a hand of 7-7-7 in spades, players who wagered on the community event would share 100% of the current prize pool, which would then reset to, say, $10,000. With these parameters, the resulting house advantage would be approximately $1-15/21-0.1-1/25=14.6\%$.

Similarly, common events on sequential games may be utilized. For example, in Roulette, a community event with the following pay table might be as follows:

| | | |
|---|---|---|
| Any zero (0 or 00) | 10 for 1 | 1 in 18 |
| Back to back any zero | 10% of pool | |
| Back to back to back any zero | 100% of pool | 1 in 5832 |

In Keno, a community event could be the occurrence of all even (or odd) numbers coming up. Indeed, Keno generally has a large house advantage of approximately 25 percent. As such, we may make this community event a "free" feature of Keno, for which any player who wagers on the game may be eligible automatically to win on the community event.

That is, a player who wagers on Keno would select numbers in the usual sense. In addition to being awarded based on the player's personal selections (either with the standard or a modified pay table), the player would then be eligible automatically to share in a prize pool should all 20 numbers that come up be even. Clearly, other manifestations are possible, and the use of even/odd, or top/bottom, etc. are merely a community event design choice.

Too, whereas the example above is given in terms of Keno, it is equally applicable to lotteries, as are commonly employed at the state level. In this case, an appropriate community event might be, for example, that all the drawn lottery balls are single digit (i.e., less than 10). Alternatively, all the balls could be divisible by 3, or end in a 9, and so forth. The examples given here are merely illustrative and are not meant to limit the teachings of this invention.

What is claimed is:

1. A method for playing a game of choice, said method comprising:

displaying at least one community event randomly occurring during play of the game of chance to players playing said game of chance, the at least one community event being common to all said players, said at least one community event having at least one winning community event outcome;

placing wagers by a plurality of said players to play for a community event jackpot payout, the amount of at least one of said placed wagers differing from the amount of at least one other of said placed wagers;

rewarding the aforesaid plurality of wagering players with the community event jackpot payout from a prize pool only when said at least one winning community event outcome randomly occurs during said play of said game of chance, a community event jackpot payout amount for each said wagering player being determined as a function of the amount of each said wagering player's placed wager, at least one said wagering player's community event jackpot payout amount differing from at least one other said wagering player's community event jackpot amount based on said differing wager amounts;

increasing the prize pool based on the wagers placed during said play of said game of chance.

2. The method of claim 1 wherein the game of chance is selected from the group consisting of:

Blackjack, Baccarat, Roulette, Keno, Pai Gow, and Pai Gow Poker.

3. The method of claim 1 wherein the at least one community event is selected from the group consisting of:

a dealer's hand in Blackjack, a Roulette spin, dealt hands in Baccarat, and a plurality of drawn balls in Keno.

4. The method of claim 3 wherein the at least one selected community event is the dealer's hand in Blackjack and the at least one winning community event outcome is selected from the group consisting of:

dealer Blackjack, dealer 7-7-7, and dealer spades 7-7-7.

5. The method of claim 3 wherein the at least one selected community event is said Roulette spin and the at least one winning community event outcome is a "00" Roulette spin result.

6. The method of claim 3 wherein the at least one selected community event comprises the dealt hand in Baccarat, and the at least one winning community event outcome is a Baccarat tie hand.

7. The method of claim 6 wherein the Baccarat tie hand is selected from the group consisting of:

an ordinary tie, natural 8 vs. 8, 3-card 8vs. 8, natural 9 vs. 9, 3-card 9 vs. 9, ace and 8 vs. ace and 8, and ace of spades and 8 of spades vs. ace of spades and 8 of spades.

8. The method of claim 3 wherein the at least one selected community event is the plurality of drawn balls in Keno, and the at least one winning community event outcome is selected from the group consisting of:

all even, all odd, all divisible by 3, all ending with the number "9," al low numbers on the top half of the board, and all high numbers on the bottom half of the board.

9. The method of claim 1 wherein the community event jackpot payout amount for each said wagering player is determined according to fixed odds.

10. The method of claim 1 wherein each said wagering player's placed wager is a fraction of the total wagers placed and wherein the determined community event jackpot payout amount for each said wagering player equals said fraction of a percentage of the prize pool.

11. The method of claim 10 wherein the percentage of the prize pool is ten percent.

12. The method of claim 10 wherein the percentage of the prize pool is one hundred percent.

13. The method of claim 1 wherein the game of chance is Blackjack, the at least one community event is the dealer's hand, and the determined community event jackpot payout amount for each said wagering player, for selected winning community event outcomes of the dealer's-hand community event, is provided according to the following pay table:

Winning community event outcome: Payout:

Dealer Blackjack 15 times each said wagering player's placed wager;

Dealer 7-7-7 a share of ten percent of the prize pool;

Dealer spades 7-7-7 a share of one hundred percent of the prize pool.

14. A method for playing a game of chance, said method comprising:

displaying at least one community event randomly occurring during play of the game of chance to players playing said game of chance, the community event being common to all said players, said at least one community event having at least one winning community event outcome;

placing wagers by a plurality of said players to play for a community event jackpot payout, the amount of at least one of said placed wagers differing from the amount of at least one other of said placed wagers;

rewarding the aforesaid plurality of wagering players with the community event jackpot payout from a prize pool only when said at least one winning community event outcome randomly occurs during said play of said game of chance, a community event jackpot payout amount for each said wagering player determined based on (a) an amount of each said wagering player's placed wager, (b) the total wagers placed and (c) the prize pool, at least one said wagering player's community event jackpot payout amount differing from at least one other said wagering player's community event jackpot amount based on said differing wager amounts;

increasing the prize pool based on the wagers placed during said play of said game of chance.

15. The method of claim 14 wherein said at least one winning community event outcome is predetermined.

16. The method of claim 14 wherein said at least one winning community event outcome is randomly selected.

17. The method of claim 14 further comprising:

selecting said at least one said community event before placing said wagers.

18. The method of claim 14 further comprising:

selecting said at least one community event after placing said wagers.

19. The method of claim 14 wherein said placing wagers comprises:

wagering on the game of chance.

20. The method of claim 14 wherein said placing wagers comprises:

wagering on the at least one community event.

21. The method of claim 14 wherein said placing wagers comprises:

choosing, by at least one player of said players playing said game of chance, at least one community event of said displayed at least one community event to wager on.

22. The method of claim 14 wherein said community event jackpot payout amount for each said wagering player is proportional to each said wagering player's placed wager.

23. The method of claim 14 wherein said community event jackpot payout amount for each said wagering player is proportional to the fraction of each said wagering player's placed wager over said total wagers placed.

24. The method of claim 14 wherein each said wagering player's placed wager is a fraction of the total wagers placed and wherein said community event jackpot payout amount for each said wagering player equals said fraction of said prize pool.

25. A method for playing a casino game, said method comprising:

displaying at least one community event randomly occurring during play of a first game of chance to players playing said first game of chance, the community event being common to all of said players, said at least one community event having at least one winning community event outcome;

placing wagers by a plurality of said players to play for a community event jackpot payout, the amount of at least one of said placed wagers differing from the amount of at least one other of said placed wagers;

rewarding the aforesaid plurality of wagering players with the community event jackpot payout from a prize pool only when said winning community event outcome randomly occurs during said play of said first game of chance, the community event jackpot payout being a percentage of the prize pool, each said wagering player's placed wager being a fraction of the total wagers placed, a community event jackpot payout amount for each said wagering player being equal to said fraction of said percentage of said prize pool, at least one said wagering player's community event jackpot payout amount differing from at least one other said wagering player's community event jackpot amount based on said differing wager amounts;

increasing the prize pool based on the wagers placed during said play of said first game of chance.

26. The method of claim 25 further comprising:

qualifying said plurality of wagering players for play of a secondary game of chance only when said at least one winning community event outcome randomly occurs during said play of said first game of chance.

27. The method of claim 26 wherein each said wagering player's chance of winning said secondary game of chance is proportional to said fraction of the total wagers placed.

28. The method of claim 26 wherein a reward from the secondary game of chance for each said wagering player is proportional to said fraction of the total wagers placed.

* * * * *

UNITED STATES PATENT AND TRADEMARK OFFICE

CERTIFICATE OF CORRECTION

PATENT NO. : 7,070,505 B2
APPLICATION NO. : 10/213315
DATED : July 4, 2006
INVENTOR(S) : Olaf Vancura et al.

It is certified that error appears in the above-identified patent and that said Letters Patent is hereby corrected as shown below:

Column 15, line 58, “choice” should be changed to -- chance --

Column 16, line 40, “8vs.” should be changed to -- 8 vs. --

Column 16, line 49, “al” should be changed to -- all --

Signed and Sealed this

Third Day of October, 2006

JON W. DUDAS
*Director of the United States Patent and Trademark Office*